United States Patent [19]

Meyers

[11] Patent Number: 4,700,988

[45] Date of Patent: Oct. 20, 1987

[54] INFANT SEAT

[76] Inventor: Roger A. Meyers, 1150 B. Westlake Blvd., Westlake Village, Calif. 91361

[21] Appl. No.: 893,391

[22] Filed: Aug. 5, 1986

[51] Int. Cl.[4] ..... A47D 1/10

[52] U.S. Cl. ..... 297/254; 297/345

[58] Field of Search ..... 297/254, 255, 256; 108/47; 182/150, 206

[56] References Cited

U.S. PATENT DOCUMENTS

| | | | |
|---|---|---|---|
| 1,049,080 | 12/1912 | Greene | 297/256 |
| 2,008,689 | 7/1935 | Donohoe | 297/255 |
| 2,843,393 | 7/1958 | Dahlander | 182/206 |
| 3,144,273 | 8/1964 | P'Simer et al. | 297/254 |
| 3,169,036 | 2/1965 | Spooner | 297/256 |
| 3,178,733 | 4/1965 | Wachsman | 297/254 |
| 3,459,450 | 8/1969 | Patollaro | 297/254 |
| 3,527,354 | 9/1970 | Sokolow | 182/150 |
| 3,727,724 | 4/1973 | Gilbert et al. | 182/206 |

*Primary Examiner*—Francis K. Zugel

*Attorney, Agent, or Firm*—Poms, Smith, Lande & Rose

[57] ABSTRACT

An infant seat is designed to attach to backs of chairs and similar objects. It has a supporting seat in which the infant sits. The seat section is attached to the chair-attaching section. Positioning means may be provided for adjusting the vertical position of the seat relative to the attaching section. The attaching section has a pair of horizontal braces designed to rest on the top of the back of the chair. A rear arm is fixed to the pair of braces and rests against the back of the back of the chair. The front arm member has sleeves which can slide on the horizontal braces. The front arm is pushed toward the back arm so that the two arms hold the infant seat to the back of the chair. When the infant is placed in the supporting seat, the sleeves of the front arm pivots slightly about the horizontal braces to lock the position of the front arm. Each arm is U-shaped so that the arm cannot fit between slats of a chair.

4 Claims, 5 Drawing Figures

INFANT SEAT

BACKGROUND OF THE INVENTION

1. Field of the Invention

This invention relates to a portable infant seat, which is attachable to the back of a standard chair.

2. Description of the Prior Art

There are many portable infant seats. Some are freestanding; others are intended to be attached to other objects, such as chairs or tables. Freestanding ones, especially high-chairs in which children sit while eating, are difficult to transport. As a result, there have been many smaller chairs, which are more portable. These chairs attach to tables or adult chairs so that they can be positioned at a dining table in a restaurant or in another's home.

Fornetti, U.S. Pat. No. 3,059,965 (1962) discloses a chair for an infant that is designed to attach and be removed from the edge of a table. There are currently available several variations on the system described in Fornetti. Especially as an infant grows and gains weight, the infant/chair combination may shift the center of gravity beyond the base of the table. The table may then fall over causing the child to fall to the floor with the table following onto the child. The stability of the table might changed while the child is attached to the table if, for example, a heavy object is removed from the opposite end of the table from the child after the child seat is attached to the table. Another potential problem occurs if the infant seat loosens from the table. Also, the child is carried at table height above the floor and falls a significant distance if the seat looses its attachment to the table.

Many infant seats are designed to rest on a horizontal surface such as a floor. Such seats have been used with dining table chairs, but the infant seats do not position the child properly with respect to the table; it is usually too low for the child to eat comfortably. In other intances, the design of the chair will not allow the infant to be close to the table.

There have been infant seats that were designed to attach to the back of a chair. At one time, before modern child safety seats became popular, it was not uncommon to seat an infant in an automobile infant seat that hooked over the automobile seat back.

Seats in automobiles share some standard characteristics that make it easier to attach infants to them. The seat back is continuous and relatively thick. The thickness usually varies within a relatively limited range. Chairs in one's home vary considerably, however. Some chairs may have a very thin back, which may have vertical slats. Other may be very plush. The seat backs of some chairs are relatively planar; others are curved. It is somewhat difficult to secure a single seat to a wide variety of seat backs.

SUMMARY OF THE INVENTION

It is an object of the present invention to disclose and provide an infant seat that can be securely fastened to a chair back with minimal risks that the seat will become dislodged. It is also desirable that the infant seat of the present invention can be attached to many different chairs having different size and design of the chair back. Another object of the present invention is to have the seat vertically adjustable with respect to the structure that supports the seat on the chair. Another object of the present invention is to disclose and provide an adjustment system for such an infant seat that allows rapid adjustment of the means holding the infant seat on the back of the chair. A further object of the present invention is to disclose and provide an attaching system for an infant seat in which the weight of the infant in the seat helps secure the adjustment mechanism against the back of the chair. Another object of the present invention is to disclose and provide an infant seat in which the infant is suspended over the seat portion of a chair so that the combined center of gravity is positioned to make that combination stable.

The infant seat of the present invention has a seat portion and associated supporting structure for supporting the infant. The attaching means, which is connected to the seat portion and which attaches the seat portion to an object such as the back of a chair, includes a brace that rests on the top of the back of the chair. A pair of depending arms are each attached to the brace and extend on opposite sides of the back of the chair below the brace. At least one of the arms can move toward and away from the other arm along the brace against the back of the chair to secure it against the chair. The arm that moves slides along to the brace. Force on the arm from the chair exerts a torque on the portion attaching the arm to the brace and temporarily wedges that connecting portion against the brace so that the arm cannot move relative to the brace when the system is loaded. Positioning means are also provided for adjusting the vertical position of the seat relative to the attaching means.

The arms are U-shaped so that at least several portions of the arms will engage part of the back of the chair. The seat of the present invention is formed out of tubular members that can be assembled easily.

DETAILED DESCRIPTION OF THE PREFERRED EMBODIMENT

The infant seat of the present invention includes supporting means for supporting an infant. In the exemplary embodiment, supporting means 10 includes two horizontal supports 12 and 14. As with most of the parts of the present invention, supports 12 and 14 are formed of a rigid material such as tubular metal or plastic. Metal members are preferably made not to corrode. They may be made of aluminum or stainless steel, they may be plated or they may be dipped in plastic or rubber material.

Figure 1:
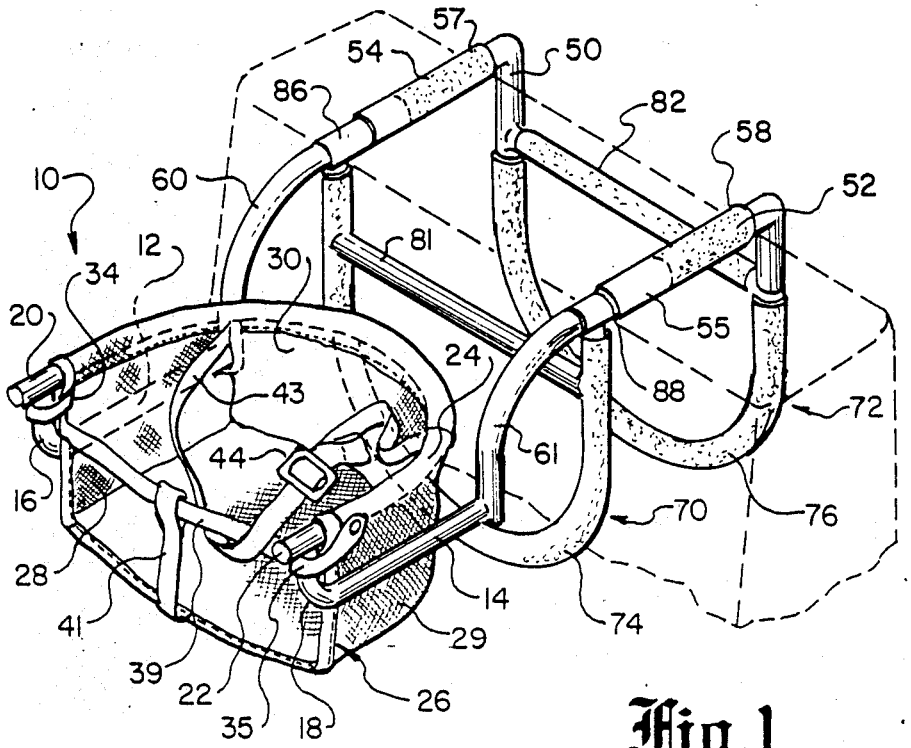
FIG. 1 is a perspective view of the infant seat of the present invention shown attached to a seat back.
Figure 2:
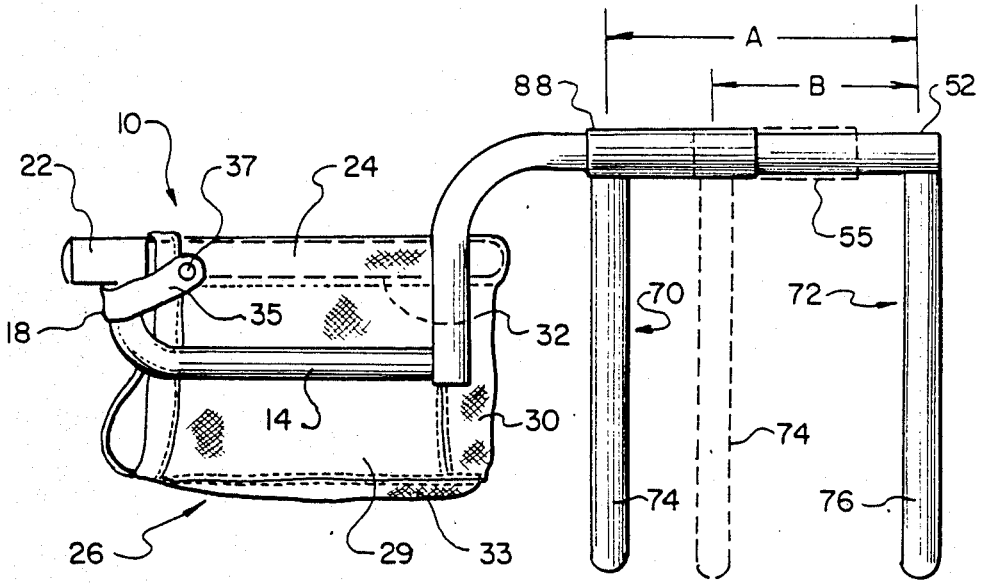
FIG. 2 is a side elevation of the infant seat of the present invention.
Figure 5:
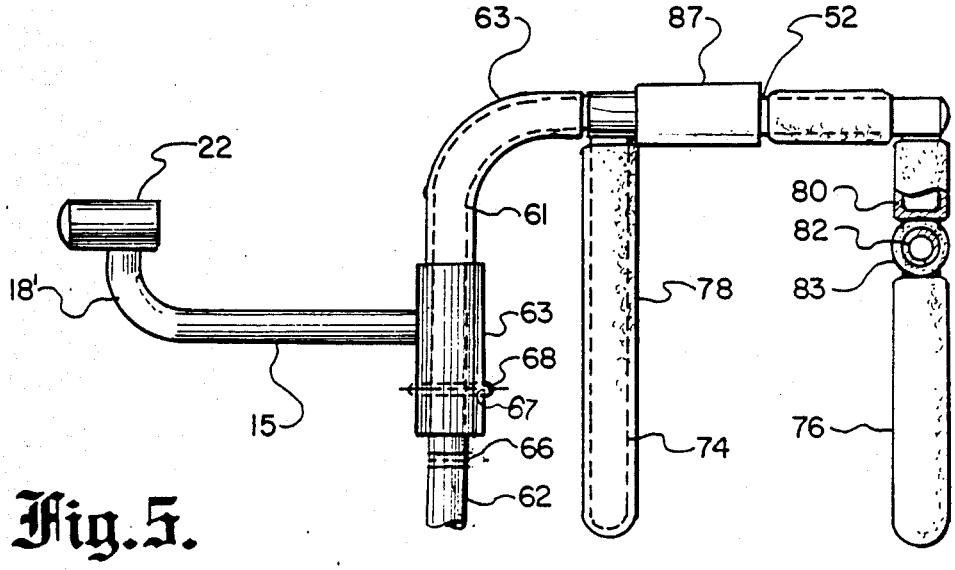
FIG. 5 is a side elevation, partially in section, showing a partially disassembled infant seat of the present invention with vertical adjustment for the sear support but with the seat portion removed.

Horizontal supports 12 and 14 each curve upward at 16 and 18 (FIGS. 1, 2 and 5). Short horizontal sleeves 20 and 22 are each welded or otherwise attached to the respective end of the upward curved portion 16 or 18. Sleeves 20 and 22 receive the ends of U-shaped rail 24 (FIGS. 1 and 2). Sleeves 20 and 22 may be provided with internal locking mechanisms to secure the ends of rail 24 in them. Rail 24 is slightly flexible. The rail can be adjusted by exerting inward or outward pressure on the sides so that its ends will be spaced the correct distance to have them received in sleeves 20 and 22. The normal curvature of rail 24 can be such that its ends do not normally align with sleeves 20 and 22. Insertion can only take place if the sides of rail 24 are pushed together or pulled apart slightly against the resilience. When the ends of rail 24 are inserted into the sleeves, the resiliency causes the outside surface of rail 24 to push against the inside surface of the respective sleeve 20 or 22. Friction then helps to secure the rail in the sleeves. Friction enhancing materials may line the insides of sleeves 20 and 22 and/or the outside of the ends of rail 24 to enhance the attachment.

Rail 24 supports hanging seat member 26 (FIGS. 1 and 2). Hanging seat member 26 is formed of flexible but strong material that can be easily cleaned. Such seat members are known in the industry. Seat member 26 includes a pair of sidewalls 28 and 29 and a rear wall 30. Bottom wall 33 is sewn to the bottom edge of sidewalls 28 and 29 and rear wall 30 (FIG. 1). Bottom wall 33 may be padded to give the infant additional comfort. The top portions of side walls 28 and rear wall 30 are looped over themselves to create a channel 32 (FIG. 2) which receives rail 24. The rail can be inserted or removed from the channel when the rail is removed from sleeves 20 and 22. A pair of short straps 34 and 35 (FIGS. 1 and 2) attach to the inside of the respective side wall 28 and 29, loop around the upward extending portions 16 and 18 of horizontal supports 12 and 14 and attach to the outside of the respective side walls 28 and 29. Fasteners, such as snap 37 (FIG. 2), allow the user to secure seat member 26 to the rest of supporting means 10.

A restraining system may be provided to prevent the infant from falling out of the seat. In the exemplary embodiment, a front horizontal strap 39 attached to side walls 28 and 29 extends in front of the infant. Vertical crotch strap 41 loops over horizontal strap 39 and is attached to the bottom wall 33 (FIG. 1). The infant normally sits with one leg on each side of crotch strap 41. A relatively long upper body strap 43, which is attached on two sides at or near the intersection of back wall 30 and sidewalls 28 and 29, is long enough to extend in front of the infant. It may be tightened by means of buckle 44 to help secure the infant within the seat. Upper body strap 43 may also loop around horizontal strap 39 and/or crotch strap 41 to help position the upper body strap.

Figure 3:
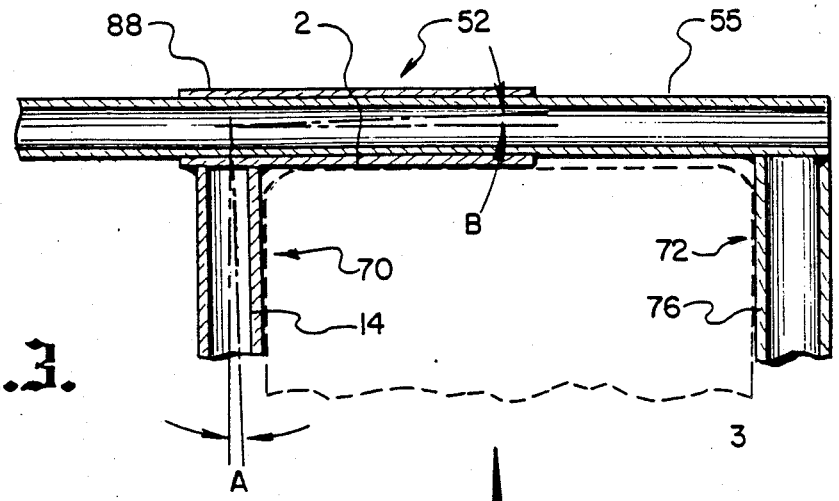
FIG. 3 is a partial side view in section of the infant seat of the present invention.

The infant seat of the present invention also includes attaching means connected to the supporting means for attaching the supporting means to an object such as the back of a chair. In the exemplary embodiment, the attaching means comprises brace means, which, in the exemplary embodiment, comprises a pair of tubular brace members 50 and 52. Each brace member has a horizontal section 54 and 55 that rests on the top of the object being supported. FIGS. 1 and 3 show the horizontal portion resting on the upper surface 2 of back 3 of the chair. The tubular members that form the horizontal portions 54 and 55 of the braces 50 and 52 are preferably dipped in a plastic or rubber material, which is shown at 57 and 58. As an alternative, removable foam padding could be provided.

The forward portion of braces 50 and 52 curve downward at curved portions 60 and 61. The curved portions 60 and 61 also may be coated with soft material 63 (FIG. 5). The bottom end of each of the curved portions 60 and 61 is attached to the respective horizontal support 12 and 14. Curved portions 60 and 61 are designed to lower the seat portion relative to upper surface 2 of back 3 of the chair so that the child is positioned closer to the seating surface of the chair and closer to any table next to the chair.

In one embodiment (FIGS. 1–4), horizontal supports 12 and 14 are fixed to curved portions 60 and 61. Positioning means between the supporting means and the attaching means adjust the vertical position of the supporting means relative to the attaching means. In the exemplary embodiment of FIG. 5, curved portion 61 has a downwardly extending section 62. Curved portion 60 has identical structure, but it cannot be seen in FIG. 5. Section 62 has a plurality of aligned holes 66. Horizontal support 15 is attached to sleeve 63, which receives section 62. Sleeve 63 and horizontal support 15 can slide vertically on section 62. Pin 68 extends through hole 67 in the sleeve and hole 66 through section 62 to fix the vertical position of the sleeve.

The attaching means also includes a pair of depending arm means, each attached to the brace means, for extending on opposite sides of the back of the chair below the brace means. The arm means 70 and 72 each comprise a U-shaped tubular arm member 74 and 76. Arm member 74 may be dipped or otherwise covered in resilient material 78 and 80 (FIG. 5) to prevent arm member 74 and 76 from damaging a chair or other object of which the present infant seat is placed. Each arm may have a cross brace 81 or 82 (FIGS. 1 and 5), and the cross braces may also be covered with soft material 83. In one embodiment (FIG. 3), rear arm member 76 is welded to horizontal brace member 55. In another embodiment (FIG. 4) rear arm member 77 has caps 79 at its upper ends. These caps receive the rear end of horizontal brace member 55 in a frictional fit. The FIG. 4 arrangement allows rear arm member 77 to be removed from horizontal braces 54 and 55 to allow for disassembly device. As explained in more detail later, removal of arm 77 from braces 54 and 55 provides a path for removal of front arm means 70.

One of the arms is mounted to the brace means for movement with respect to the other arm. In the exemplary embodiment, front arm means 70 moves and rear arm 72 is stationery. The upper ends of arm member 74 in the exemplary embodiment are each welded to a horizontal sleeve 86 and 88. The inside diameter of each sleeve 86 and 88 is slightly greater than the outside diameter of each horizontal brace 54 and 55 and any associated coating (FIGS. 2 and 3). Front arm means 70 moves toward and away from rear arm 72.

Normally one would position the infant seat of the present invention over chair back 3 and then squeeze arm means 70 and 72 together (from spacing A to spacing B in FIG. 2). The infant would then be placed in supporting means 10. The weight of the infant causes forward arm means 72 to rotate slightly about angle a (FIG. 3). This change in turn causes sleeve 88 to rotate slightly about angle b. Because sleeves 88 and 86 rotate slightly with respect to their horizontal brace member 55 or 54, the sleeve and the brace member become slightly skewed to each other. This slight skewing tends to lock the sleeve in a fixed position relative to the respective brace member so that the distance between the respective arm means 70 and 72 remains fixed. As a result, the arm means can be held tightly against the front and back of the back of the chair so that the infant seat is held rigidly. Any dipped coating enhances the locking between sleeves 86 and 88 and the respective horizontal brace member 54 and 55. Skewing also help to hold sleeve 63 in a fixed position on lower portion 62 (FIG. 5).

Figure 4:
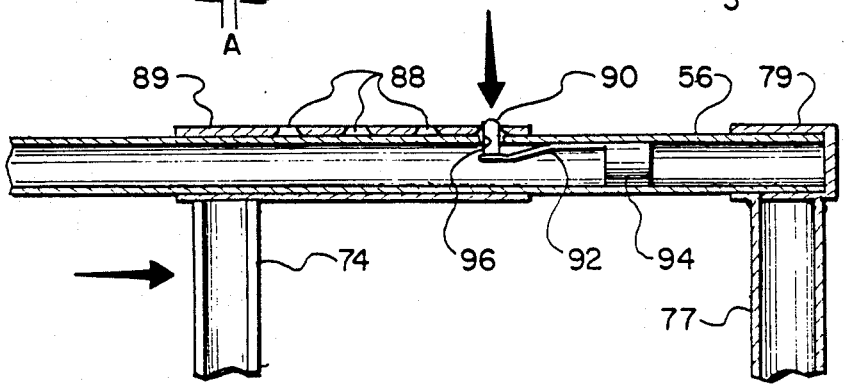
FIG. 4 is also a side elevation in section, but it shows an alternative embodiment of the present invention.

Additional locking systems may also be provided. FIG. 4 shows one alternative. It includes a pin 90, mounted at one end of leaf spring 92, which in turn is mounted to a block 94 fixed within brace member 56. Pin 90 projects through an aperture 96 in brace member 56. Sleeve 89 is provided with several spaced, longitudinally aligned openings 98 that are positioned such that they pass above pin 90 and aperture 96 when sleeve 89 slide along horizontal brace 56. When one of the openings 98 is above aperture 96, spring 92 forces pin 90 through aperture 96 and the appropriate opening 98 to lock sleeve 98 relative to horizontal brace 56. One depresses pin 90 until it is out of opening 98 so that sleeve 89 can slide along horizontal brace 56 for adjustment.

If rear arm means 72 is removable as in FIG. 4, one can also slide sleeve 89 and the sleeve from the other side from arm 74 off horizontal braces 54 and 55. This allows the device to be disassembled for transporting or for shipment.

As numerous modifications and alternate embodiments will occur to those skilled in the art, it is intended that the invention be limited only in terms of the appended claims.

I claim:

1. In a seat for supporting an infant comprising supporting means for supporting the infant and attaching means connected to the supporting means for attaching the supporting means to an object, the improvement in attaching means comprising the provision of:

brace means attached to the attaching means for resting on a portion of the object;

a pair of depending arm means, each attached to the brace means for extending on opposite sides of the object below the brace means; and mounting means between the brace means and the arm means for moving the arm means toward each other against the object, wherein the brace means comprise a pair of spaced apart tubular brace members at least one of the arm means having a pair of sleeves receiving the tubular brace members such that the sleeves can slide relative to the tubular brace members, each sleeve having a short portion extending from the arm means toward the supporting means and a long portion extending from the arm means toward the other arm.

2. The attaching means of claim 1, wherein the inside diameter of each sleeve is sufficiently greater than the outside diameter of the respective brace member so that each sleeve can pivot slightly with respect to its brace meber.

3. In a seat for supporting an infant comprising supporting means for supporting the infant and attaching means connected to the supporting means for attaching the supporting means to an object, the improvement in attaching means comprising the provision of:

brace means attached to the attaching means for resting on a portion of the object;

a pair of depending arm means, each attached to the brace means for extending on opposite sides of the object below the brace means; and mounting means between the brace means and the arm means for moving the arm means toward each other against the object, wherein the brace means comprise a pair of spaced apart tubular brace members, at least one of the arm means having a pair of sleeves receiving the tubular brace members such that the sleeves can slide relative to the tubular brace members, each sleeve having a first portion extending from the arm means toward the supporting mans and a second portion extending from the arm means toward the other arm.

4. The improved attaching means of claim 3, wherein the inside diameter of each sleeve is sufficiently greater than the outside diameter of the respective brace member so that each sleeve can pivot slightly with respect to its brace member.

* * * * *